United States Patent [19]

Josef

[11] Patent Number: 4,829,681

[45] Date of Patent: May 16, 1989

[54] PAPER MACHINE CLOTHING

[75] Inventor: Michael J. Josef, Clifton Park, N.Y.

[73] Assignee: Albany International Corp., Menands, N.Y.

[21] Appl. No.: 739,755

[22] Filed: May 30, 1985

Related U.S. Application Data

[63] Continuation of Ser. No. 465,626, Feb. 10, 1983, abandoned.

[51] Int. Cl.[4] ..... B32B 17/04

[52] U.S. Cl. ..... 34/123; 34/116

[58] Field of Search ..... 139/383 A; 34/116, 123; 428/234

[56] References Cited

U.S. PATENT DOCUMENTS 3,653,961 4/1972 Lefkowitz ..... 139/383 A 4,350,731 9/1982 Siracusano ..... 139/383 A

*Primary Examiner*—Henry A. Bennet

*Attorney, Agent, or Firm*—Kane, Dalsimer, Sullivan, Kurucz, Levy, Eisele, & Richard

[57] ABSTRACT

Paper machine clothing comprising interwoven machine direction and cross-machine direction yarns are provided, wherein the machine direction yarns are monofilaments having specific resistance to hydrolysis. The woven fabrics, after heat-setting, exhibit exceptional resistance to abrasion and hydrolysis.

2 Claims, 2 Drawing Sheets

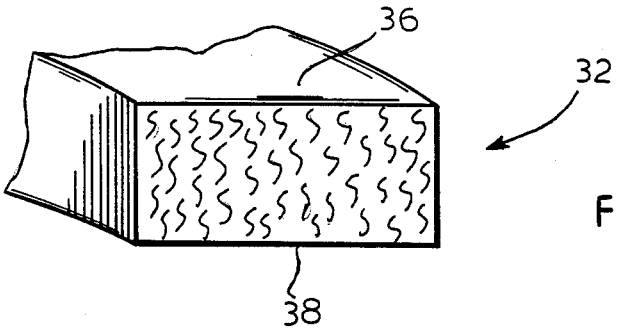
FIG.4
FIG.5
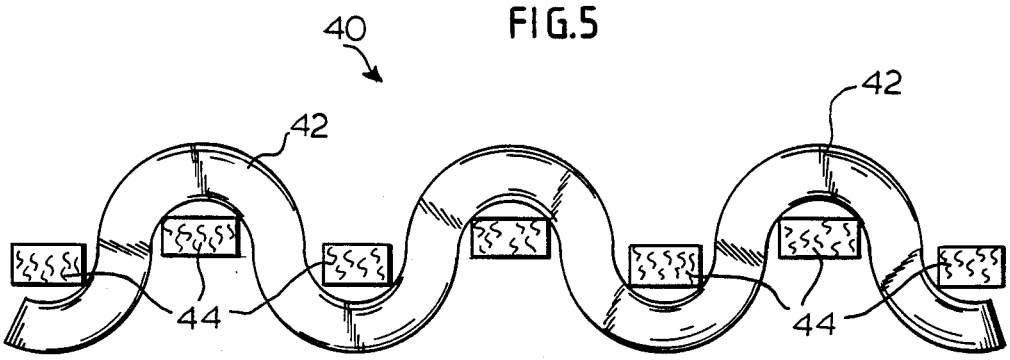
FIG.6
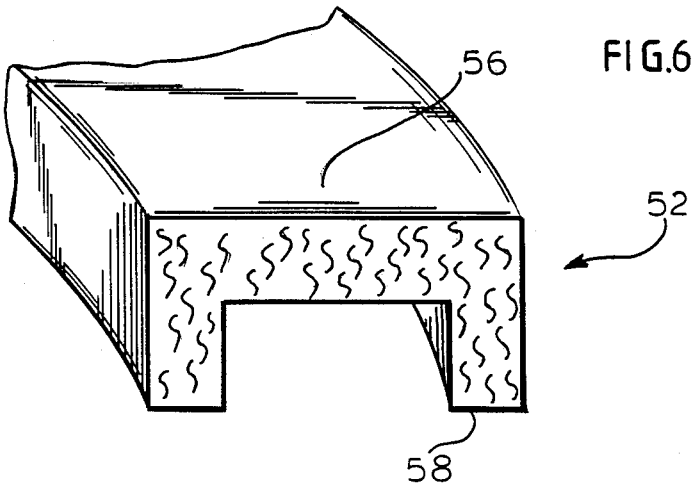

PAPER MACHINE CLOTHING

This is a continuation of co-pending application Ser. No. 465,626 filed on Feb. 10, 1983 now abandoned.

BACKGROUND OF THE INVENTION

1. Field of the Invention

The invention relates to paper machine clothing useful for fabrication of dryer belts, employed in the dryer section of a papermaking machine.

2. Brief Description of the Prior Art

Papermaking machines are well known in the art. The modern papermaking machine is in essence a device for removing water from the paper furnish. The water is removed sequentially in three stages or sections of the machine. In the first or forming section, the furnish is deposited on a moving forming wire and water drained through the wire to leave a paper sheet or web having a solids content of circa 18 to 25 percent by weight. The formed web is carried into a wet press felt section and passed through one or more nip presses on a moving press felt to remove sufficient water to form a sheet having a solids content of 36 to 44 percent by weight. This sheet is transferred to the dryer section of the papermaking machine where dryer felts press the paper sheet to hot steam heated cylinders to obtain a 92 to 96 percent solids content.

On papermaking machines, endless belts are employed in the various sections to carry the sheet or web of paper. There are wide variety of forms of the endless belts, some fabricated from metal and others from textile material such as cotton, cotton and asbestos or cotton, asbestos and synthetic fibrous or filamentous materials. The selection of a given material is dependent to some degree upon the use to which the fabric will be put, i.e.; as a forming fabric dryer felt, etc.

Dryer belts for use in the drying section of the papermaking machine have historically been fabricated from dryer felt fabrics. In recent years, one form of belt commonly employed in the dryer section of a papermaking machine is referred to as a "screen" and is fabricated by weaving synthetic monofilaments or twisted multi-filaments together in an open weave. Although not subjected to any form of milling, and therefore not "felts" in the original sense of the term, these screen fabrics have also become known as "dryer felts". The endless belts are generally woven flat and the ends thereafter joined to form an endless belt The weave selected may be a two or three layer weave of synthetic yarns such as multifilament, spun or monofilament yarns.

In carrying the formed paper web through the dryer section of the papermaking machine, the felt aids in drying, controls shrinkage of the paper web and prevents cockles. The felt fabric must possess strength, dimensional stability, resistance to chemical and thermal degradation, resistance to abrasion and have a functional permeability. In recent years all monofilament structured fabrics have been developed to meet the above-described needs of a dryer felt. However, dryer felts fabricated from all monofilament fabrics, have heretofore not been entirely satisfactory.

Dryer belts fabricated from monofilaments of synthetic polymeric resins are subject to abrasion and moist heat hydrolysis In many of the prior art constructions the load bearing machine direction monofilament yarns may be rapidly degraded under some conditions of use so that the life of the dryer felt is shortened.

With the structured fabrics of the present invention, many of the above-described shortcomings of the prior art are removed. Dryer belts constructed according to the invention may be fabricated from an all monofilament fabric which is more resistant to degradative elements. The overall operating life of the forming wires and felts is significantly increased over prior art felts.

SUMMARY OF THE INVENTION

The invention comprises a papermachine dryer fabric, which comprises;

interwoven machine direction monofilament yarns of a synthetic, polymeric resin and cross-machine direction textile yarns;

said monofilament yarns being characterized by a resistance to moist heat degradation such that they retain at least 50 percent of their original tensile strength following 10 days of exposure to a temperature of 250° F. in an autoclave under 15 PSIG of steam.

BRIEF DESCRIPTION OF THE DRAWINGS

FIG. 4 is a cross-sectional view of the machine direction yarn shown in FIG. 3.

FIG. 5 is a view as in FIG. 1 but of still another embodiment fabric of the invention.

FIG. 6 is a cross-sectional, perspective view of another machine direction yarn, which may be used in fabrics of the invention.

DETAILED DESCRIPTION OF THE PREFERRED EMBODIMENTS OF THE INVENTION

Those skilled in the art will gain an appreciation of the preferred embodiments of the invention by a reading of the following description in conjunction with a viewing of the accompanying drawings of FIGS. 1–6, inclusive.

Figure 1:
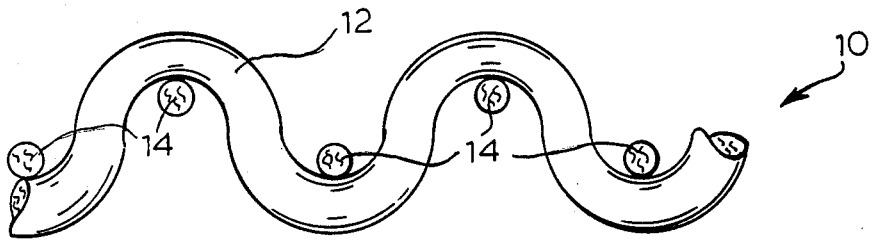
FIG. 1 is an enlarged, cross-sectional, side elevation along the machine direction of an embodiment fabric of the invention.

FIG. 1 is an enlarged, cross-sectional, side elevation along the machine direction of an embodiment fabric 10 of the invention. The fabric 10 is made up by an interweaving of the machine direction yarn 12 with a plurality of cross-machine direction yarns 14. The yarns 12, 14 shown in FIG. 1 are monofilaments and may be extruded monofilaments of any known synthetic, polymeric resin in any conventional denier. Representative of preferred monofilament yarns are monofilament yarns of polyesters, polyamides, polyaramids, polyolefins and the like which do not absorb high proportions of moisture. A shown in FIG. 1, the machine direction yarn 12 has a greater diameter than the cross-machine direction 14. The cross-machine direction yarns are preferably monofilaments with an average diameter of from about 0.008 to 0.016 inches to provide a high degree of stability and structural integrity in the fabric of the invention. Preferably for a dryer felt, low absorption monofilament yarns are employed.

The machine direction monofilament yarns 12 are round and generally of a greater diameter, i.e.; within the range of from about 0.16 to 0.04 inches, to provide a greater degree of abrasion and hydrolysis resistance in the fabric 10. The exact average diameter of the machine direction yarn 14 selected will depend to some extent upon the nature of the polymeric resin, from which the yarn 14 is extruded. The yarn 14 is selected from yarns which retain at least 50 percent of their original tensile strength following exposure for 10 days to a temperature of 250° F. in an autoclave under 15 PSIG of steam. In general, such yarns 14 are found in monofilaments of a greater average diameter than was heretofore used as machine direction yarns in papermakers' dryer fabrics.

Figure 2:
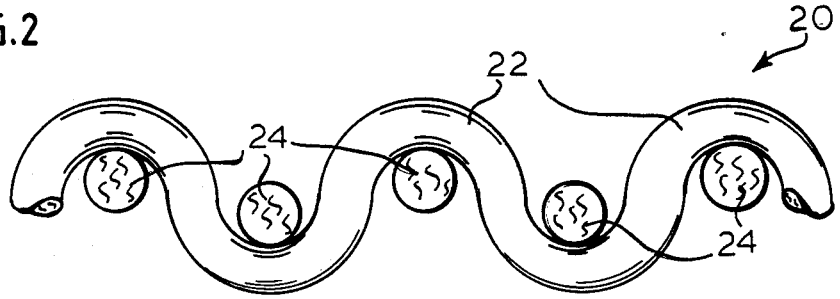
FIG. 2 is a view as in FIG. 1 of another embodiment fabric of the invention.

In FIG. 2, the embodiment fabric 20 is shown as in FIG. 1, wherein the machine direction yarn 22 interweaves with cross-machine direction yarns 24. The fabric 20 differs from the fabric 10 of FIG. 1 only in that the cross-machine direction yarns 24 have an average diameter equal to the average diameter of machine direction yarn 22, generally greater than the diameter of hitherto employed fabric yarns used in papermaking dryer felt fabrics.

Figure 3:
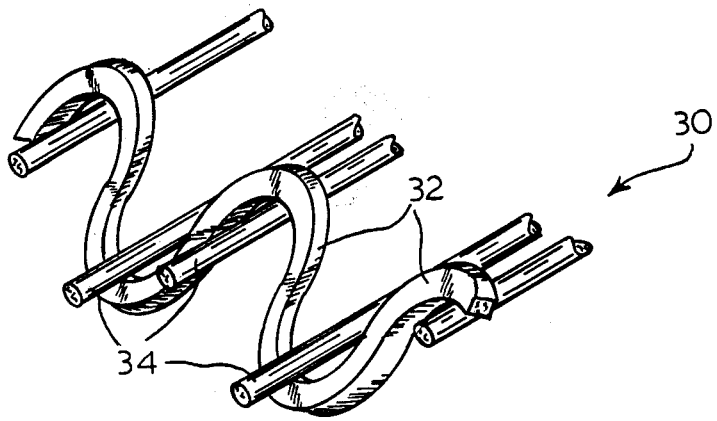
FIG. 3 is a schematic view of the weave of still another embodiment fabric of the invention.

The FIG. 3 is a schematic view of a dryer felt fabric 30 of the invention which comprises a machine direction yarn 32 interwoven with a plurality of cross-machine direction yarns 34 The fabric 30 differs from the fabrics 10 and 20 described above in that the machine direction yarn 32 is of a rectangular (including a square) cross-sectional configuration. Referring to FIG. 4, one can see that the yarn 32 has a relatively large top surface 36 area matched by the relatively large lower surface 38 area. Yarns 32, i.e.; yarns having the configuration of yarn 32 are preferred in fabrics of the invention, because they appear to have unexpected resistance to abrasion and hydrolysis. Preferably the yarns 32 will have a width in surfaces 36, 38 of from about 0.035 to 0.00 inches and a thickness of about 0.024 to 0.035 inches in comparison to yarns employed in the prior art, for the same or similar purposes, having a thickness of about 0.01 inches and a width of about 0.027 inches.

The fabrics of the invention also include those wherein the cross-machine direction yarns also have a rectangular or square cross-sectional configuration as shown in FIG. 5, a cross-sectional side elevation, enlarged of a fabric 40. The fabric 40 comprises interwoven machine direction yarns 42 and cross-machine direction yarns 44. The yarns 42, 44 are both similar to the yarn 32 described above and having a high degree of abrasion and hydrolysis resistance.

Those skilled in the art will appreciate from the above that the configuration of the yarns used to fabricate the fabrics of the invention is not critical. Any configuration may be used, including for example an inverted "U" shape such as the yarn 52 shown in FIG. 6, a cross-sectional view of another yarn which may be used to fabricate the fabrics of the invention. The yarn 52 has a top surface 56 for contact with the paper web being dried and a lower surface 58 for contacting the cross-machine direction yarns.

To fabricate the fabrics of the invention, any one of the monofilaments 12, 22, 32 or 52 or a like monofilament is employed as the machine direction yarn in the otherwise conventional weaving of a papermakers' fabric. Any conventional weave pattern may be employed. Following the manufacture of the fabrics of the invention, the fabrics may be heat-set to stabilize the fabric and to draw the yarns into desired relative positions. The degree of heat-setting required to achieve the desired structure of the fabric will of course vary depending on the polymer nature of the yarns. However, optimum times, temperatures and tensions placed on the fabric during heat-setting can be determined by those skilled in the art, employing trial and error technique for the different yarn materials. In general, heat-setting may be carried out at temperatures of from about 150° F. to 400° F. for from 15 to 60 minutes.

The following examples describe the manner and the process of making and using the invention and set forth the best mode contemplated by the inventor of carrying out the invention but is not to be construed as limiting.

EXAMPLE 1

A fabric is prepared in a weave of 0.024"×0.035" flat polyester monofilament (40 per inch) machine direction yarn and 0.028" diameter round monofilament cross-machine direction yarns 18 per inch). After heat-setting, a fabric is obtained having a smooth surface contacting outer plane.

The fabric is made endless with a pin seam and installed as a dryer felt on a papermaking machine. Any other conventional means of seaming the fabric may also be employed. Paper products are unmarked by the contact with the dryer felt. The belt exhibits a high degree of dimensional stability when run on a papermaking machine. A representative sample of the felt fabric is subjected to testing to determine its hydrolysis resistance. A representative portion of the machine direction yarn is also tested. The test results are given in the Table I, below. In the test procedure, samples were cut to 1" strips and subjected to 250° F. at 15 PSIG steam in an autoclave and periodically sampled for up to 10 days. Samples were tested on a floor Instron using a 10"/min. crosshead speed, 10"/min. chart speed, and a 5" gauge length. Single ends collected from a 1" strip were tested on the table Instron using the same parameters described above.

EXAMPLE 2

The procedure of Example 1, supra., is repeated, except that in place of the 0.024"×0.035 " flat machine direction yarns, there is substituted 0.016 round monofilaments of the same polyester. The test results are shown in Table I,

TABLE I

| | FABRIC OF EXAMPLE 1 | | FABRIC OF EXAMPLE 2 | |
|---|---|---|---|---|
| Day | Tensile Strength (lb./inch) | % Strength Retained | Tensile Strength (lb./inch) | % Strength Retained |
| 0 | 1466 | — | 1070 | — |
| 3 | 1360 | 92 | 1047 | 98 |
| 6 | 1433 | 97 | 873 | 82 |
| 10 | 933 | 68 | 137 | 13 |
| | SINGLE ENDS - EXAMPLE 1 | | SINGLE ENDS - EXAMPLE 2 | |
| Day | Tensile Strength (lb./inch) | % Strength Retained | Tensile Strength (lb./inch) | % Strength Retained |
| 0 | 44.7 | — | 15.5 | — |
| 3 | 45.3 | 100 | 13.3 | 85 |
| 6 | 45.0 | 100 | 11.2 | 72 |
| 10 | 26.7 | 58 | — | — |

Those skilled in the art will appreciate that many modifications of the preferred embodiments described above may be made without departing from the spirit and the scope of the invention. For example, the fabric of the invention may be woven to include various stuffer picks, to obtain dryer fabrics of different permeabilities as will be appreciated by those skilled in the art.

Similarly, although the fabrics described above are simple, single layer weaves, those skilled in the art will appreciate that the scope of the invention includes multi-layered and complex weaves incorporating the variously shaped monofilaments as a part of their structures.

The felts of the invention may also be finished in any conventional manner, i.e.; for example chemical treatments to offer specific properties of runability and resistance to chemical and abrasive degradation.

What is claimed is:

1. A paper machine dryer fabric, which comprises:

interwoven machine direction monofilament yarns of a synthetic, polymeric, polyester resin and cross-machine direction synthetic, polymeric, polyester resin monofilament yarns;

said monofilament yarns being characterized by a resistance to moist heat degradation such that they retain at least 50 percent of their original tensile strength following ten days of exposure to a temperature of 250° F. in an autoclave under 15 psig of steam;

said fabric having a woven construction of all monofilament yarns.

2. The fabric of claim 1 which is a woven, single layer fabric.

* * * * *

UNITED STATES PATENT AND TRADEMARK OFFICE

CERTIFICATE OF CORRECTION

PATENT NO. : 4,829,681

DATED : May 16, 1989

INVENTOR(S) : Michael J. Josef

It is certified that error appears in the above-identified patent and that said Letters Patent is hereby corrected as shown below:

In column 3, line 34 of the Patent, change "0.00" to --0.060--.

Signed and Sealed this

Fourteenth Day of July, 1992

*Attest:*

*Attesting Officer*

DOUGLAS B. COMER

*Acting Commissioner of Patents and Trademarks*